US009668057B1

(12) United States Patent
Jayne

(10) Patent No.: US 9,668,057 B1
(45) Date of Patent: May 30, 2017

(54) RIBBON TRANSDUCER

(71) Applicant: Richard Allen Jayne, Lansing, NY (US)

(72) Inventor: Richard Allen Jayne, Lansing, NY (US)

( * ) Notice: Subject to any disclaimer, the term of this patent is extended or adjusted under 35 U.S.C. 154(b) by 0 days.

(21) Appl. No.: 15/089,931

(22) Filed: Apr. 4, 2016

(51) Int. Cl.
*H04R 1/00* (2006.01)
*H04R 7/14* (2006.01)
*H04R 31/00* (2006.01)

(52) U.S. Cl.
CPC ..... *H04R 7/14* (2013.01); *H04R 31/003* (2013.01)

(58) Field of Classification Search
CPC ..... H04R 7/14; H04R 31/003
USPC ..... 381/399
See application file for complete search history.

(56) References Cited

U.S. PATENT DOCUMENTS 3,564,163 A * 2/1971 Hobrough ..... H04R 9/048 181/166
3,872,564 A * 3/1975 Myers ..... E04C 2/36 428/116
4,321,434 A * 3/1982 Irie ..... H04R 7/14 181/172
4,550,228 A 10/1985 Walker et al.
5,195,143 A * 3/1993 Spiegel ..... H04R 9/048 181/164
2007/0286447 A1* 12/2007 Tomiyama ..... H04R 9/025 381/400
2009/0010480 A1* 1/2009 Ding ..... H04R 7/20 381/395
2016/0198265 A1* 7/2016 Timmins ..... H04R 9/048 381/91

* cited by examiner

*Primary Examiner* — Tuan D Nguyen
(74) *Attorney, Agent, or Firm* — Brown & Michaels, PC

(57) ABSTRACT

A "free swinging" acoustical ribbon transducer with increased vibrating ribbon element reliability, power handling, and extended useful frequency range. This performance is achieved by forming the corrugations in the vibrating ribbon element at an angle in a range of approximately 45 degrees to 75 degrees with respect to the transverse direction, and preferably in a range of 54 degrees to 74 degrees with respect to the transverse direction.

10 Claims, 7 Drawing Sheets

RIBBON TRANSDUCER

BACKGROUND OF THE INVENTION

Field of the Invention

The invention pertains to the field of acoustic transducers. More particularly, the invention pertains to "free swinging" acoustical ribbon transducers with ribbon elements mechanically terminated only at their ends.

Description of Related Art

A ribbon audio transducer is a type of speaker or microphone, as shown in FIG. 11, in which the sound is generated by a thin strip of metal ribbon 111 which is suspended between two permanent magnets 110*a* and 110*b*. A small gap 115 between each of the magnets 110*a* and 110*b* and the edges of the ribbon 111 allows the ribbon 111 to vibrate. The ends of the ribbon 111 are held by mounts 113*a* and 113*b* which are electrically isolated from each other and electrically connected to the ends of the ribbon 111. An audio source 112 is connected to each of the mounts 113*a* and 113*b* by wires 114.

When the transducer is used as a speaker, an alternating current created by signal from the audio source 112 passes through the ribbon 111, and a varying magnetic field is created. The interaction of the static magnetic field between the permanent magnets 110*a* and 110*b* and the varying magnetic field around the ribbon 111 causes the ribbon 111 to vibrate in time to the alternating current, which causes the ribbon 111 to produce sound. If the transducer is used as a microphone, sound waves impinging on the ribbon 111 cause it to move, and as is known to the art, movement of a conductor through a static magnetic field causes an alternating current signal at the ends of the conductor.

This sort of ribbon type audio transducer, where the vibrating ribbon element 111 is mechanically terminated only at its ends or at its ends 113*a* 113*b* (and possibly at points along its length as in the case of a long ribbon divided up into shorter sections) is sometimes referred to as "free swinging" or "true ribbon" designs. These designs are in contrast to vibrating ribbon or planer magnetic elements that are terminated on all sides.

As shown in FIG. 7, ribbon audio transducer vibrating elements 71 are typically formed with corrugations 72 running perpendicular to the longitudinal axis of the ribbon element. This will be referred herein to as the "transverse direction". These corrugations 72 produce a transverse stiffness to the vibrating element to resist flexures in this direction.

As shown in FIG. 6*a*, these transverse corrugations 62 which run in the transverse direction L1 provide a compliance or spring effect 63 along the length of the ribbon element. This compliance along the length of the ribbon element allows mild tensioning F of the ribbon 61 as it is mounted in its magnet assembly 60, and holds the ribbon element in the gap between rows of magnets that are part of said assembly. This compliance 63 along the ribbon element's length also allows the ribbon element to move freely in the lateral direction as is necessary in reproducing sound waves as in a loudspeaker or in response to sound waves as in a ribbon microphone. However the compliance of the ribbon element in the longitudinal direction that results from transverse corrugations is extremely high. This extreme compliance along the length of the ribbon element gives very little control of the "free swinging" ribbon element's movements in the lateral direction. This fact limits practical sized ribbon transducers with transverse corrugations to higher frequency operation where lateral movements are small.

The larger movements and increased lateral forces associated with lower frequency operation easily overwhelms transverse corrugated ribbon elements and can stress the ribbon material past its mechanical yield point resulting in an elongation of the ribbon element and a loss of the ribbon element's initially installed tension. Also this extreme compliance gives almost no control over standing wave activity at lower frequencies as the transversely corrugated ribbon easily submits to the forces producing this phenomenon resulting in limited power handling and low frequency response irregularities.

Another undesirable phenomenon associated with transversely corrugated ribbon elements is referred to as "twisting" where the ribbon undergoes a torsional movement along its longitudinal axis.

As a result of these performance issues, prior art ribbon designs that attempt to reproduce higher sound pressure levels and or lower frequencies have been undesirably large structures, increasing the ribbon's surface area so as to reduce the magnitude of the excursions associated with lower frequency operation. This fact has limited practical sized free swinging ribbon audio transducers with transverse corrugations to use only at the higher audio frequencies, typically above 1000 hertz or more.

To achieve reliable response below 1000 hertz, the free swinging designs have resorted to undesirably large designs ranging from approximately 2 to 7 feet in length. This spreads the drive forces of lower frequency operation out over a larger area thus reducing the peak to peak movements to a point where the ribbon elements lack of motional control is less problematic. This approach does not result in a practical sized loudspeaker as desired by most audio system users.

Walker, U.S. Pat. No. 4,550,228 shows a "Ribbon Speaker System" of the prior art. All but one of the Walker figures show ribbon elements with corrugations which are perpendicular to the longitudinal axis of the ribbon, as was common in the prior art. FIG. 7 of the Walker patent shows a ribbon element which has corrugations at "a variable angle relative to the vertical axis of the ribbon in order to provide a variable spring support in line with the acoustical drive and to provide mechanical crosswise stiffness". This design does not use a "free swinging" ribbon element, as "ribbon 760 is attached to the inside edges of strips 780 and 781 means of pressure-sensitive-adhesive covered foam strips 772".

SUMMARY OF THE INVENTION

This invention provides a "free swinging" acoustical ribbon transducer with increased vibrating ribbon element reliability, power handling, and extended useful frequency range. This performance is achieved by forming the corrugations in the vibrating ribbon element at an angle in a range of approximately 45 degrees to 75 degrees with respect to the transverse direction, and preferably in a range of 54 degrees to 74 degrees with respect to the transverse direction.

DETAILED DESCRIPTION OF THE INVENTION

Figure 1:
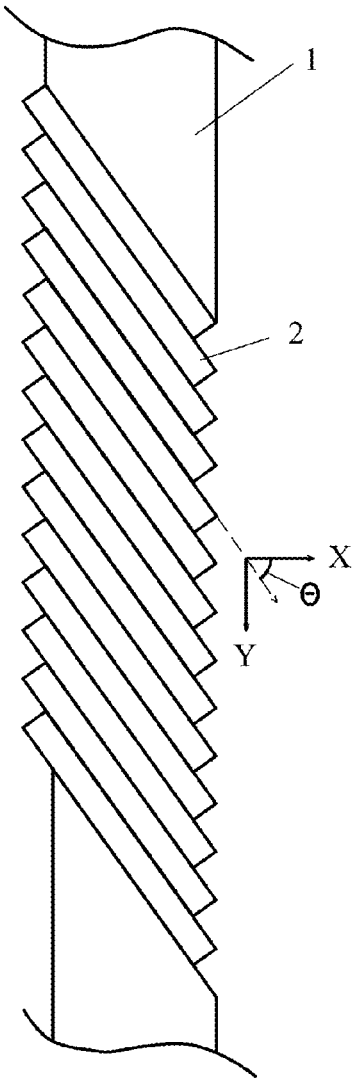
FIG. 1 shows a ribbon for a transducer with the vibrating ribbon element corrugations formed at an angle with respect to the transverse direction.
Figure 7:
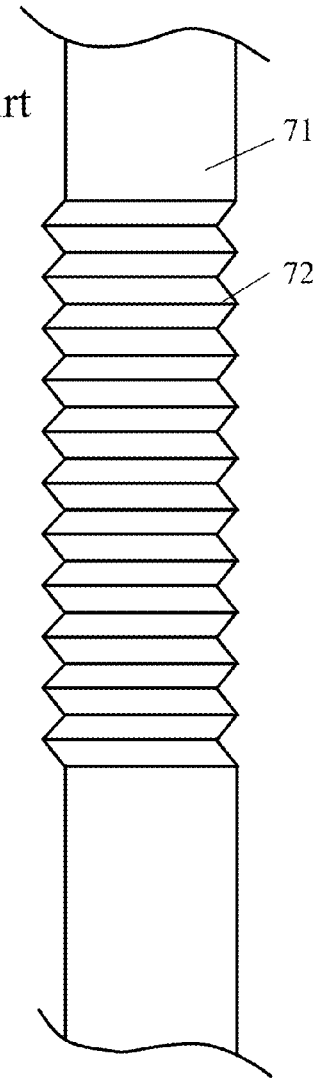
Fig. 7 Prior Art
FIG. 7 shows a prior art ribbon transducer with the vibrating ribbon element corrugations formed in the transverse direction.
Figure 11:
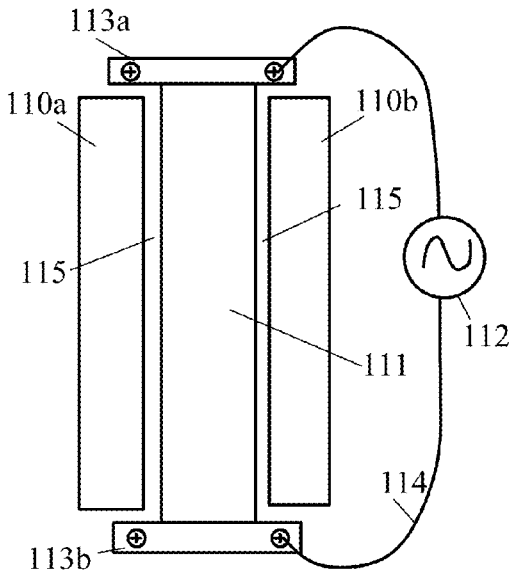
Fig. 11 Prior Art
FIG. 11 shows a prior art free swinging ribbon transducer.

FIG. 1 shows a ribbon element 1 for a ribbon transducer. The transverse axis should be understood as a line X running across the width of the ribbon element 1 from the first side to the second side. The transverse axis is perpendicular to the ribbon element's longitudinal axis Y which runs along the length of the ribbon element from the first end to the second end. The term "lateral" should be understood to mean a direction forward and backward, orthogonal to both the longitudinal and transverse axes (in other words, a direction into and out of the paper in FIG. 1).

In the present design the ribbon element 1 is formed with corrugations 2 set at an angle θ with respect to the X axis. The corrugations 2 are evenly spaced along substantially all of the length of the ribbon element 1, although it will be understood that the corrugations 2 may be left off near the ends of the ribbon element 1 to facility connection between the ends of the ribbon element 1 and the terminations as will be described below. By forming the corrugations 2 across the ribbon element 1 at an angle θ, a significant increase in spring rate and structural rigidity is achieved along the Y axis.

This increased spring rate (lower compliance) and structural rigidity gives increased resistance to the stronger drive forces encountered at lower operating frequencies. These two properties combine to produce useful increases in the ribbon element's motional control, extending the use of practical sized ribbon transducers to lower frequency operation. This ability is highly desirable not only in high performance loudspeaker design but opens practical sized free swinging ribbon designs to use with "mid-fi" quality, low frequency cone type audio transducers. With angled corrugations 2, a practical sized free swinging ribbon is now able to meet the reliability requirements of that market.

Mathematical analysis and physical testing of the spring rate increase along the length of the ribbon element 1 show good correlation and ribbon elements with corrugations 2 formed at an angle θ show solid improvements in usable band width and reliability over other ribbon element designs.

To date, testing has shown that ribbon element 1 corrugations 2 formed at angles θ somewhere between approximately 45 degrees and 75 degrees, and preferably in the range of 54 degrees to 74 degrees, with respect to the transverse direction X have produced the most useful results depending on application and ribbon size. Corrugations set at smaller angles with respect to the transverse direction will produce a smaller increase in both longitudinal spring rate and longitudinal structural stiffness. Corrugations set at larger angles with respect to the transverse direction X will produce larger increases in both longitudinal spring rate and longitudinal structural stiffness.

Ribbon transducers that will be used at lower frequencies benefit from larger corrugation angles. The increase in longitudinal spring rate resulting from larger corrugation gives considerable freedom in tuning the ribbons main resonance as well as a useful increase in ribbon element excursion control in the lateral direction. Testing has shown that the mechanical properties resulting from said ribbon element design work together to produce useful improvements in low frequency excursion control, standing wave suppression, power handling, and suppression of the "twist" phenomenon allowing practical sized ribbon transducers to operate reliably at lower frequencies.

Figure 2:
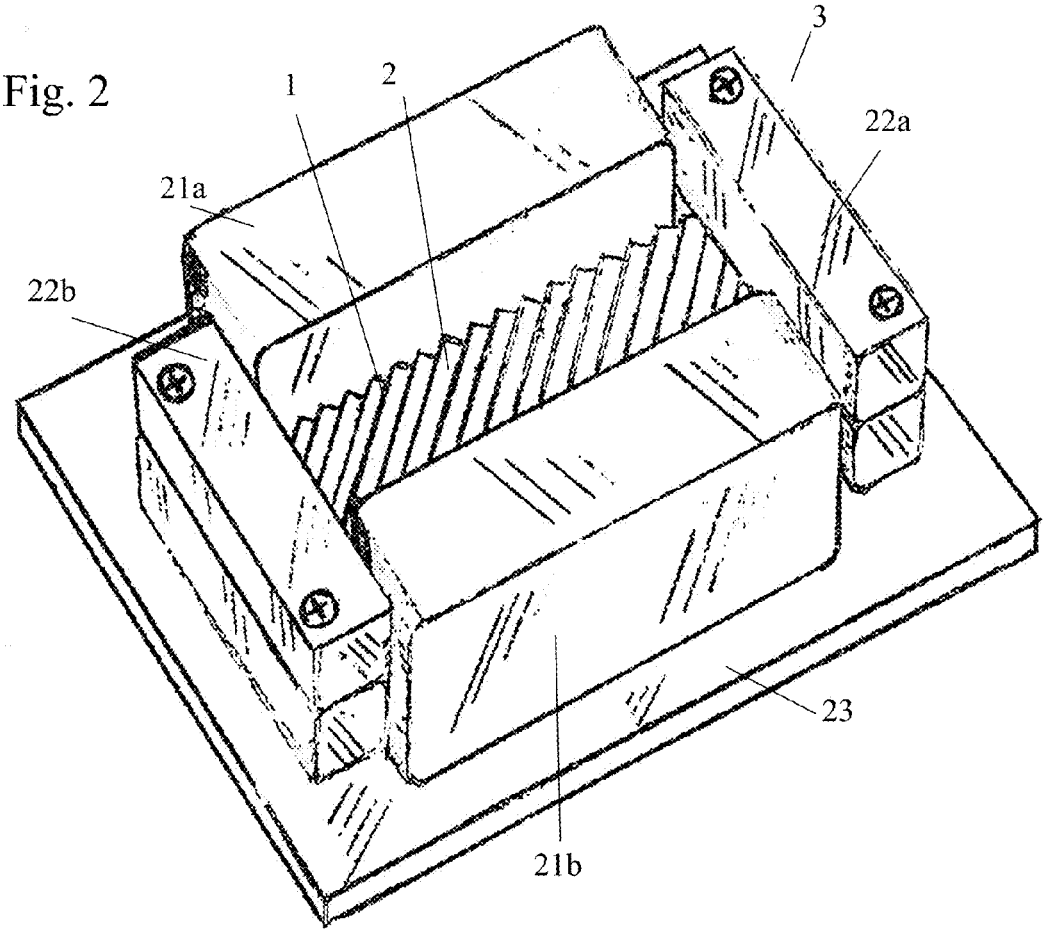
FIG. 2 shows a perspective view of ribbon transducer with the vibrating ribbon element corrugations formed at an angle.
Figure 3A:
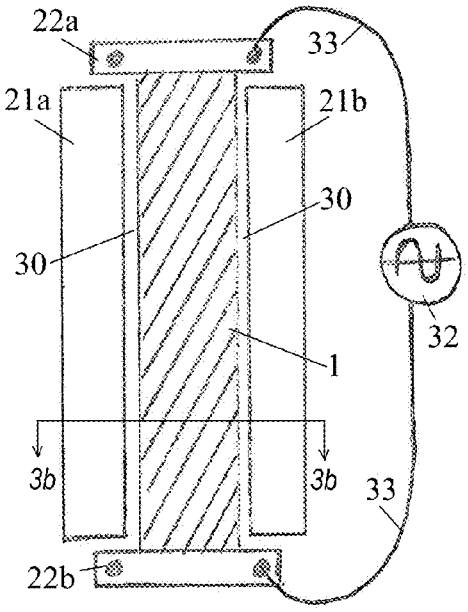
FIG. 3*a* shows a front view of a ribbon element mounted between two magnets.
Figure 3B:
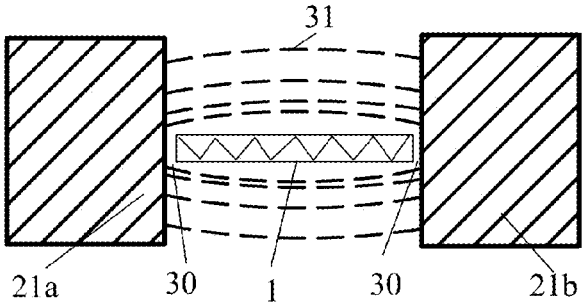
FIG. 3*b* shows a view of the ribbon element and magnets from FIG. 3*a*, cut-through along lines 3*b*-3*b* in FIG. 3*a*.

FIG. 2 shows a perspective view of a ribbon element 1 with angled corrugations 2 installed in a ribbon transducer 3. FIG. 3*a* shows a schematic depiction of the transducer of FIG. 2, and FIG. 3*b* shows a diagram of the magnetic flux on a cut-through 3*b*-3*b* in FIG. 3*a*.

As shown in the figures, the ribbon element 1 is suspended between mechanical and electrical terminations 22*a* and 22*b*, which hold the ribbon element 1 in place, and allow electrical connection to the ends of the element 1. The terminations 22*a* and 22*b* are preferably designed as an adjustable clamp which can be loosened to allow the ribbon element 1 to be placed and the tension adjusted, and then can be tightened to hold the ribbon element in place at the desired tension. As shown in the figure, this can be simply done with adjustment screws, or through other means known to the art.

Permanent magnets 21*a* and 21*b* are mounted next to the ribbon element 1, with a small gap 30 between element 1 and magnets 21*a* and 21*b* allowing the element 1 to move without mechanically interfering with the magnets 21*a* and 21*b*. When an electrical signal 32 is connected to the terminations 22*a* and 22*b*, a current passes through the ribbon element 1. The permanent magnets 21*a* and 21*b* create lines of magnetic flux 31 around the ribbon element 1. Interaction between the fixed flux lines 31 from the magnets 21*a* and 21*b* and the varying magnetic field created by the signal 32 current in the ribbon element 1 cause the ribbon element to move, which creates sound waves from the transducer. It will be understood that this works equally in reverse—a movement of ribbon element 1 in the flux 31 caused by sound pressures creates an electrical current between the terminations 22*a* and 22*b*.

All of the elements of the transducer 3 can be mounted on a base plate 23 as shown in FIG. 2, or they can be mounted to the frame of a speaker assembly or other mountings as are known to the art.

Figure 6A:
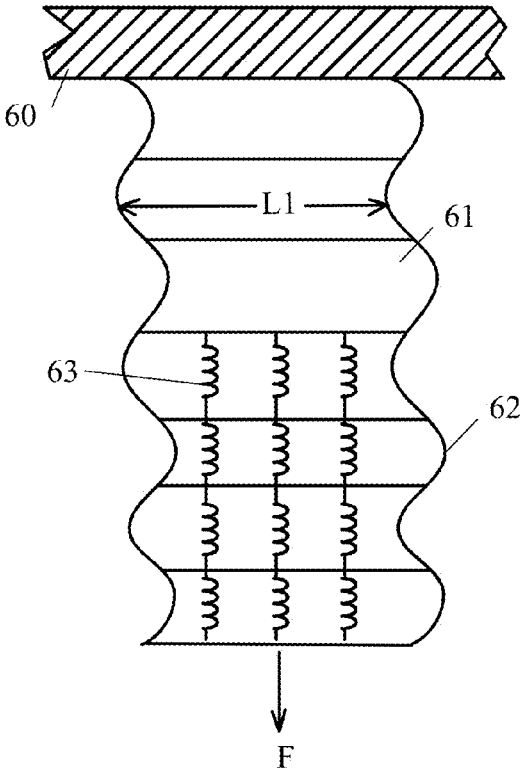
Fig. 6a Prior Art
FIG. 6*a* is a diagram of spring forces in a corrugated ribbon of the prior art.
Figure 6B:
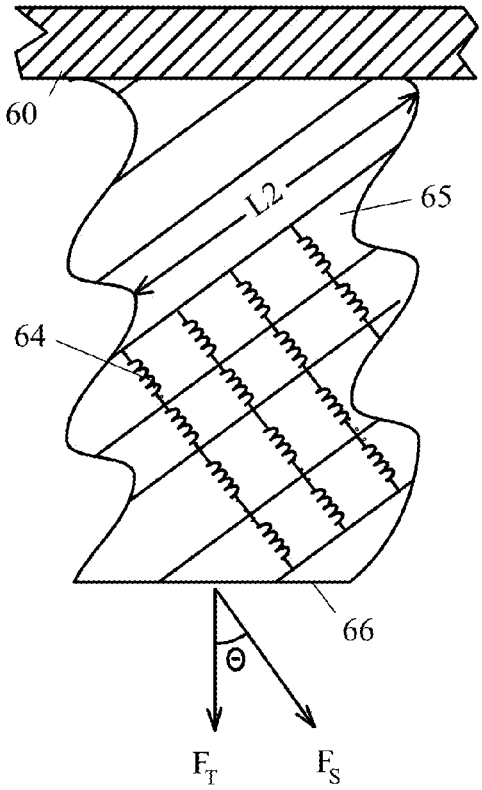
FIG. 6*b* is a diagram of spring forces in a corrugated ribbon of the invention.

FIG. 6*b* shows a diagram of the spring effects of a ribbon element 66 having corrugations 65 which are at an angle along the line L2. As a result, the corrugation "spring" trajectory $F_s$ is at angle θ to the ribbon tension force trajectory $F_T$, and the length L2 of each corrugation 65 is longer than the length L1 in the transverse direction in the prior art FIG. 6*a*. The combined result of a longer corrugation length L1, and the corrugation spring trajectory set at an angle to the ribbon tension trajectory results in substantial and highly tunable increases in ribbon elements longitudinal spring rate. Therefore, the allowable ribbon tensioning along $F_T$ of the ribbon 66 either as it is mounted in its magnet assembly 60, or from the higher lateral forces of lower frequency operation, can be higher than that for the prior art FIG. 6*a*. For an example where the corrugation angle is 60 degrees, the increase in allowable ribbon tension force can be calculated to be four times that of the transverse corrugations 62 of prior art FIG. 6*a*.

Ribbon Angled Corrugation Tests

Experiments with free swinging ribbon audio transducers ranging in length from 1 inch to several feet show that by forming the vibrating ribbon diaphragm with corrugations set at a certain range of angles resulted in increased motional control, improved reliability, increased power handling, extension of usable low frequency limit, and ability to use lower order crossover filtering.

Experiments with corrugation angles θ ranging between 10 degrees and 80 degrees (understanding that zero degrees is on the transverse axis X, normal to the ribbon element's length dimension Y), revealed that the best results were consistently obtained with corrugations formed at an angle of approximately 64 degrees+/−10 degrees. This range of angles produces a balance between the stiffness needed to control larger diaphragm movements, and the flexibility needed to allow them. Angles below this range exhibited extremely high compliance similar to ribbons formed with transverse corrugations and did not achieve the desired increase in motional control. Angles above this range result in an extremely low compliance, limiting the peak excursion and a loss of rigidity across the width of the diaphragm resulting in audible flapping sounds under hard drive.

It was found that in any given free swinging ribbon design, taking into account constraints such as thermal or mechanical overload, that forming the ribbon diaphragm corrugations at angles near the lower end of this range, approx. 54 to 61 degrees extended reliable operation to approximately one-half octave lower. Angles in the middle of this range, approximately 60 to 68 degrees, allow approximately 1 octave lower operation. Angles in the upper end of this range, 67 to 74 degrees allow approximately 2 octave lower operation.

This method was found to produce an increase in the ribbon diaphragms' longitudinal spring rate and structural rigidity resulting in improved control over peak excursions, standing waves, twisting modes, and side to side instabilities. The added control was significant, allowing operation to higher power levels, lower frequency's, and permitting the use of lower order crossover filtering, allowing a given ribbon size to be used in a wider range of applications with improved reliability and fidelity.

Figure 8:
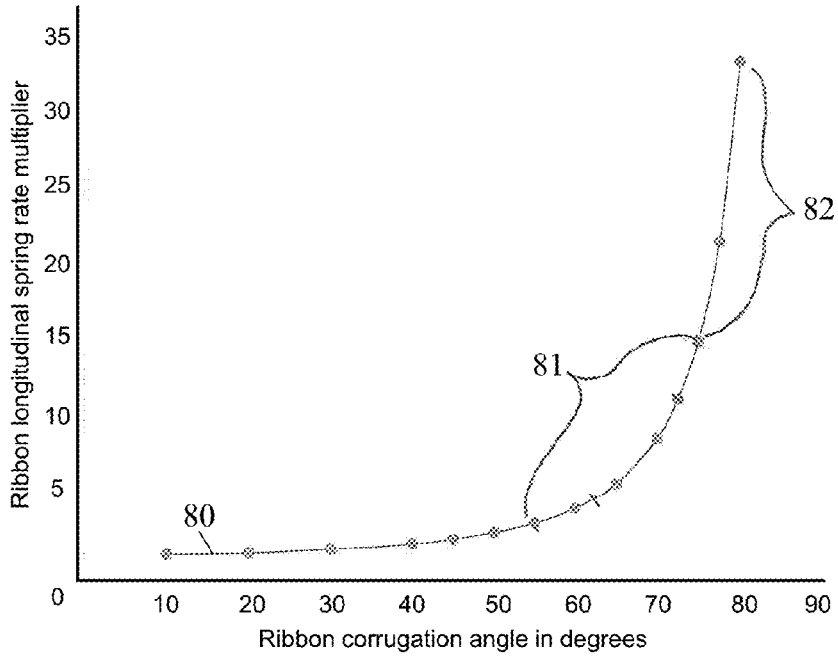
FIG. 8 shows a graph of ribbon spring rate vs. corrugation angle.

Compliance testing of 15 ribbon elements with corrugation angles ranging from 10 to 80 degrees was conducted in 5 degree increments, and the graph shown in FIG. 8 representing the relationship between ribbon diaphragm longitudinal stiffness and corrugation angle was generated.

TABLE 1

Ribbon Corrugation Angle vs. Spring Rate Multiplier

| Ribbon Corrugation Angle | Ribbon Longitudinal Spring Rate Multiplier |
|---|---|
| 10 | 1.04 |
| 20 | 1.12 |
| 30 | 1.35 |
| 40 | 1.69 |
| 45 | 1.99 |
| 50 | 2.43 |
| 55 | 3.03 |
| 60 | 4 |
| 65 | 5.57 |
| 70 | 8.53 |
| 72.5 | 11.11 |
| 75 | 14.9 |
| 77.5 | 21.33 |
| 80 | 33.17 |

FIG. 8 shows a graph of the relationship of ribbon corrugation angle ("x" axis) to ribbon longitudinal spring rate multiplier ("y" axis). The line 80 on the graph shows that the spring rate multiplier remains low up to about 45 degrees. In this zone, the ribbon is too compliant along the longitudinal axis. Above approximately 45 degrees, the plotted line 80 on the graph displays a progressive profile with a pronounced "knee" section. It was found that the corrugation angles 81 that produced the best results in actual use, approximately 54 to 74 degrees, align directly with the knee of the curve representing this relationship. It is clearly seen from this curve's progression that corrugation angles centered about this knee area 81 avoid compliance extremes.

The section of line 80 indicated with brackets 81 shows the area of the curve which has been found experimentally to be the preferred corrugation angles—approximately 54 degrees to 74 degrees. Mathematical analysis of this relationship agrees with these findings, further validating the results. It is this range of angles that avoids the extremes of the curve and produce the most useful balance between ribbon diaphragm longitudinal stiffness and flexibility without compromising rigidity across the diaphragms width to a point where flapping or hinging become audible, and represents a range that allows tuning by selection of corrugation angle to align these properties to a range of ribbons sizes, power requirements, and frequency response needs.

After about 75 degrees the line 80 is nearly vertical, as shown by brackets 82—this indicates that in this zone, the ribbon has become too stiff longitudinally. At the same time, the ribbon has become too compliant across the width dimension.

Methods of Forming the Ribbon Element

Figure 4:
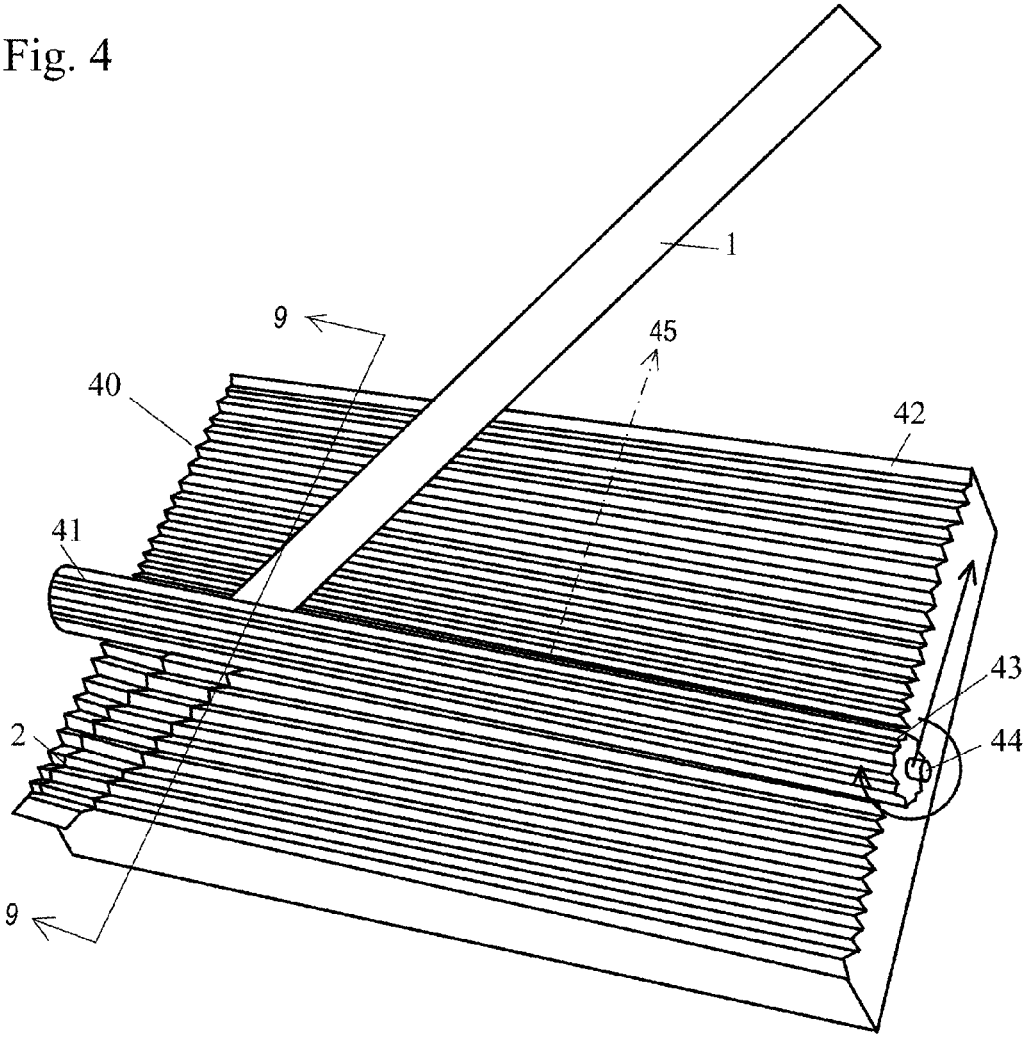
FIG. 4 shows a perspective view of a first embodiment of a fixture for forming a corrugated vibrating ribbon element using a rack and pinion arrangement.
Figure 9:
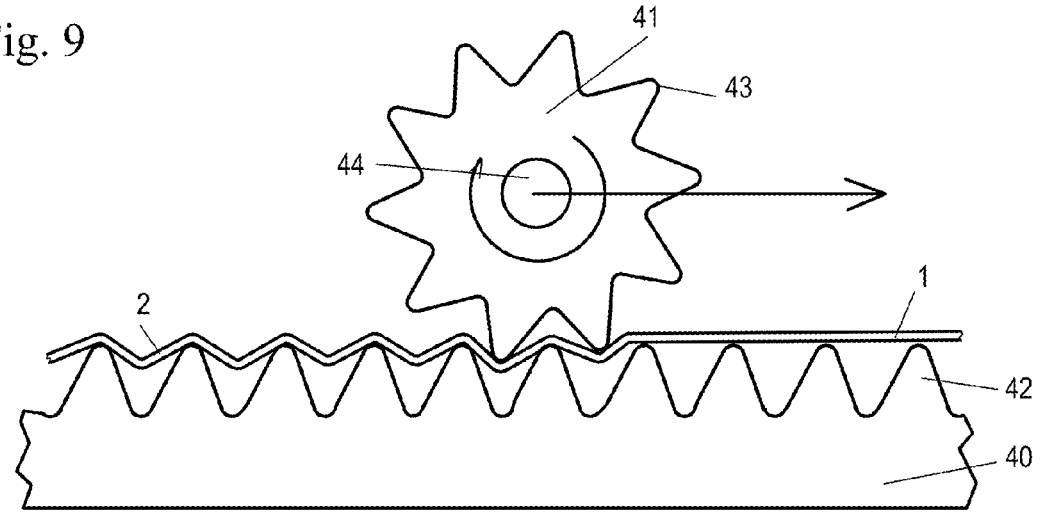
FIG. 9 shows a side view of the fixture of FIG. 4, cut through along line 9-9 in FIG. 4.

FIG. 4 shows a perspective view of a first embodiment of a fixture for forming a corrugated vibrating ribbon element 1 using a rack 40 and pinion 41 arrangement. FIG. 9 shows a cut-through view of FIG. 4 along the lines 9-9. In this method of forming the ribbon element 1, the flat ribbon element 1 is placed on the rack 40 at the desired angle, and the pinion 41 is rotated about its axis 44. This causes the pinion 41 to travel along the rack 40 as indicated by dash-dot line 45, and the teeth 43 of the pinion 41 bend the ribbon element 1 against the teeth 42 of the rack 40, causing the angled corrugations 2 to form.

Figure 5:
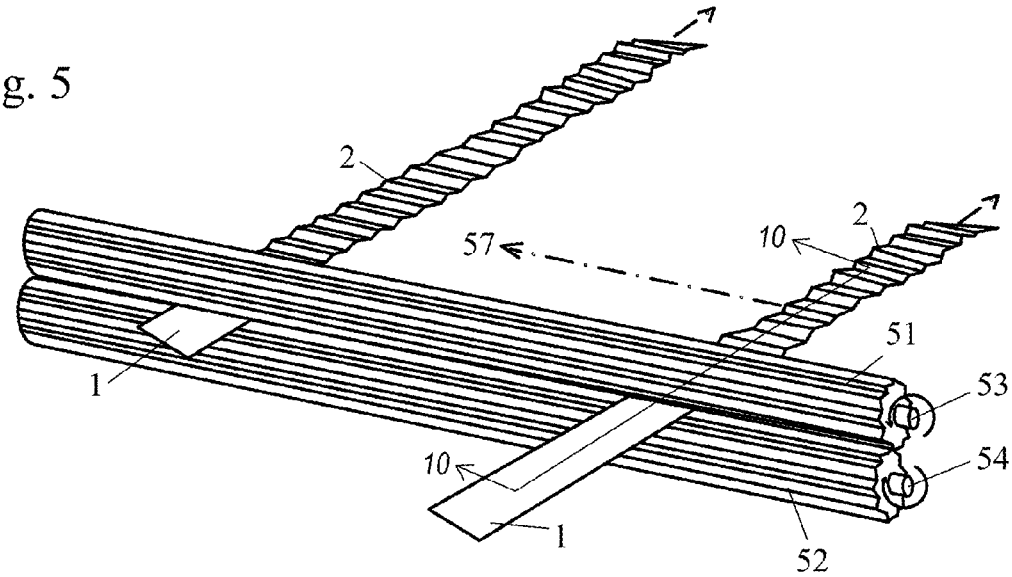
FIG. 5 shows a perspective view of a second embodiment of a fixture for forming a corrugated vibrating ribbon element, using a pair of pinions.
Figure 10:
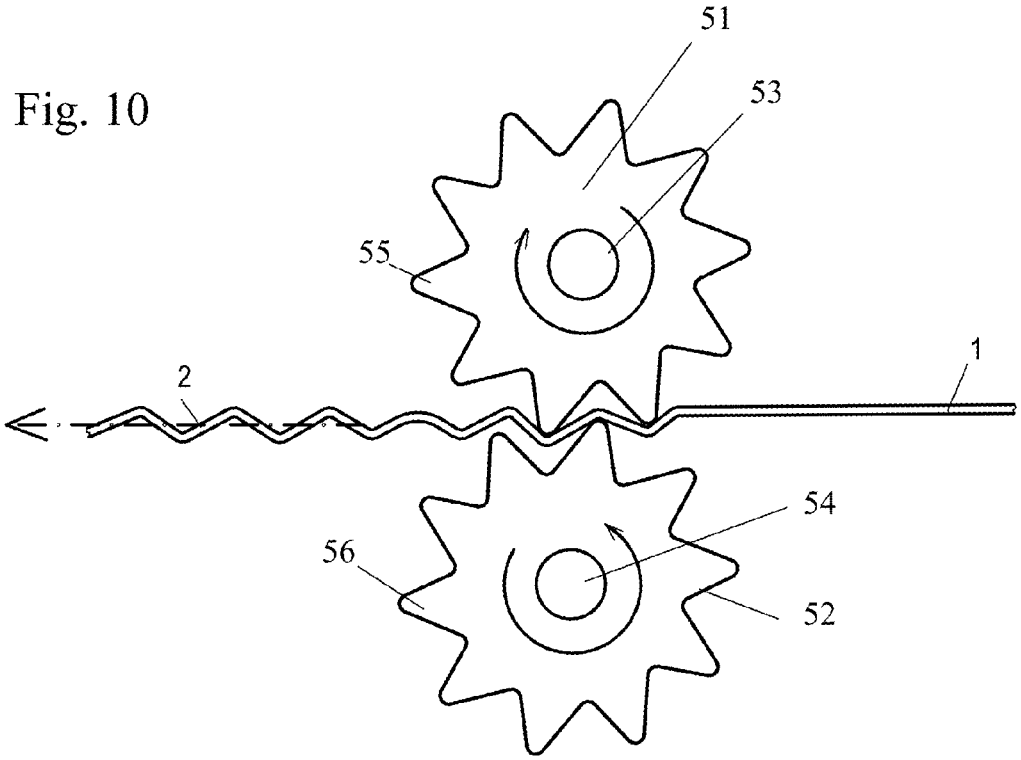
FIG. 10 shows a side view of the fixture of FIG. 5, cut through along line 10-10 in FIG. 5.

FIG. 5 shows a perspective view of a second embodiment of a fixture for forming a corrugated vibrating ribbon element 1, using a pair of pinions 51 and 52. FIG. 10 shows a cut-through view of the embodiment of FIG. 5 along the lines 10-10. In this embodiment, the teeth 55 of pinion 51 interlock with the teeth 56 of pinion 52. As the pinions 51 and 52 rotate about their respective axes 53 and 54, the ribbon element 1 is fed between the pinions at the desired angle. The ribbon element 1 is crimped between the teeth 55 and 56, forming the angled corrugations 2. As the crimps are formed, the ribbon 1 is drawn across the paired pinions 51 and 52, as indicated by the dash-dot arrow 57.

"Composite Ribbon" Embodiment of the Invention

This embodiment provides a "free swinging" acoustical ribbon transducer with increased vibrating ribbon element reliability, power handling, damping, and extended useful frequency range. This performance is achieved by forming two ribbon elements with angled corrugations as described above, bonded together with a suitable adhesive to form a composite "sandwich" with the corrugations of each ribbon element of the composite being formed at sufficiently different angles such that each individual corrugation peak of one ribbon crosses over and contacts two or more corrugation peaks of the other ribbon.

It is understood that the "corrugation peaks" are the areas of each ribbon element in closest proximity to the ribbon element it is being bonded to forming a "composite" ribbon element made up of two ribbon elements or one long element folded back over itself.

Figure 15:
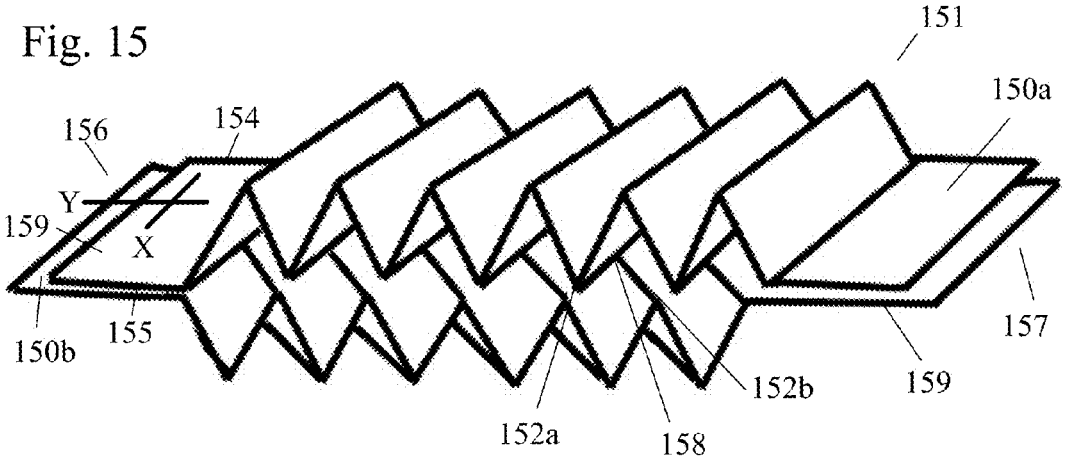
FIG. 15 shows an embodiment of the invention in the form of a "composite" ribbon element made up of two ribbon elements.

FIG. 15 shows the arrangement of two ribbon elements 150*a* and 150*b* with angled corrugations 152*a* and 152*b* forming the composite ribbon element 151 for a ribbon transducer. The transverse axis X should be understood as a line running across the width of the ribbon element 150*a* 150*b* from the first side 154 to the second side 155. The transverse axis X is perpendicular to the ribbon element's longitudinal axis Y which runs along the length of the ribbon element 150*a* 150*b* from the first end 156 to the second end 157.

In the present design the composite ribbon element 151 is formed by bonding two ribbon elements 150*a* and 150*b* each with different corrugation angles 152*a* and 152*b* together. The corrugation angles of each ribbon element are formed to be sufficiently different to result in the corrugation peaks of one ribbon element crossing or contacting two or more corrugation peaks of the ribbon element it is bonded to. Having two or more contact points 158 along the peak of each corrugation 152*a* 152*b* between the two ribbon elements of the composite ribbon stabilizes the connection between the two elements avoiding hinging and rocking, and buzzing between the two elements that happens with a single contact point.

Figure 16:
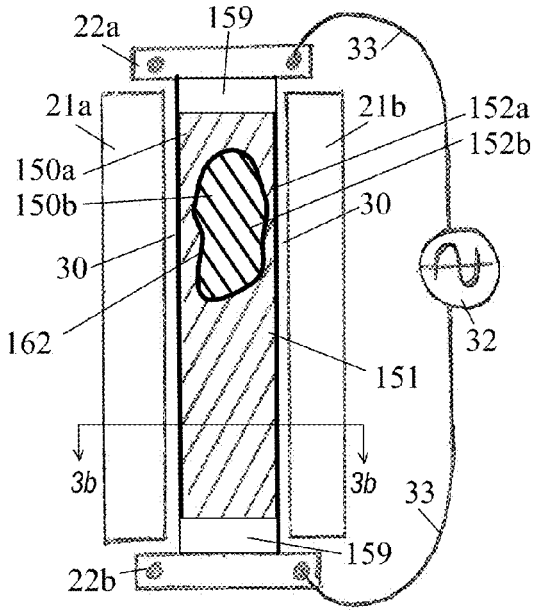
FIG. 16 shows a a front view of a "composite" ribbon element of the embodiment of FIG. 15, mounted between two magnets.

FIG. 16 shows a transducer using the composite ribbon element 151. The parts of FIG. 16 which were shown and discussed with respect to FIG. 3 above will not be separately discussed here, but those elements will be understood from the foregoing discussion of the single-ribbon embodiment.

In FIG. 16, the composite ribbon 151 is shown with a transparent area 162 so that the corrugations 152*b* of ribbon element 150*b* which underlies ribbon element 150*a* in the figure can be seen. The corrugations 152*a* 152*b* are evenly spaced along substantially all of the length of the ribbon element 150*a* 150*b*, although it will be understood that the corrugations may be left off near the ends 159 of the ribbon elements 150*a* 150*b* to facilitate connection between the ends of the ribbon element 150*a* 150*b* and the terminations 22*a* and 22*b*.

Figure 12A:
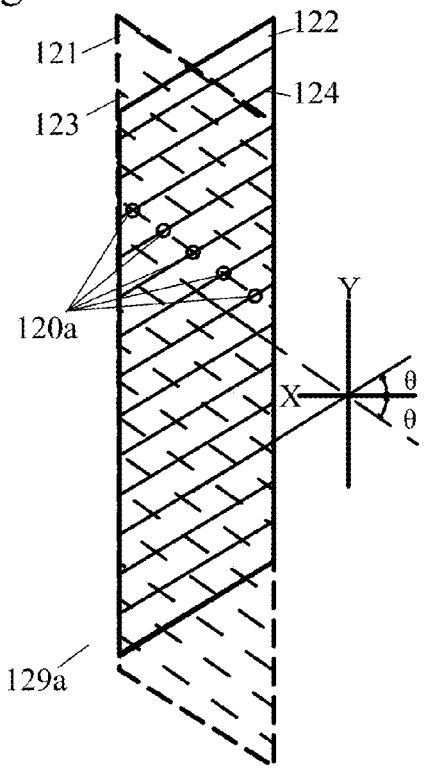
FIGS. 12*a* and 12*b* show top views of two examples of "composite" ribbon elements of the embodiment of FIG. 15.
Figure 12B:
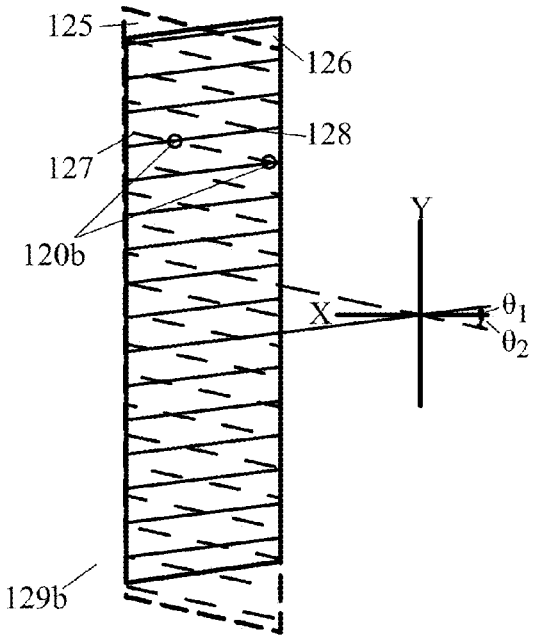

FIGS. 12*a* and 12*b* show top views of portions of two examples of free swinging ribbon elements 129*a* and 129*b* constructed as a composite of two ribbon elements 121 and 122, and 125 and 126, bonded together with the corrugations of each formed at different angles. The solid lines 124 and 128 represent the peaks of the corrugations of the ribbon element facing the viewer 122 and 126. The dashed lines 123 and 127 represent the peaks of the corrugations of the ribbon element facing away from the viewer 121 and 125.

The ribbons 121 and 122 in FIG. 12*a* have relatively large corrugation angles θ with respect to the X-axis, as is shown in the figure. Ribbons 125 and 126 in FIG. 12*b*, on the other hand, have smaller (and different) corrugation angles $\theta_1$ and $\theta_2$.

The larger corrugation angles θ with respect to the X-axis in FIG. 12*a* result in an increased number of contact points 120*a* between the two ribbon elements 121 and 122, resulting in a larger number of adhesive contact points.

As shown in FIG. 12*b*, the smaller corrugation angles $\theta_1$ and $\theta_2$ with respect to the X-axis result in a smaller number of contact points 120*b* between the two ribbon elements 125 and 126, resulting in a smaller number of adhesive contact points.

As can be seen in FIGS. 12*a* and 12*b*, changing the corrugation angles θ and $\theta_1$ and $\theta_2$ results in the ability to increase or decrease the number of adhesive contact points 120*a* 120*b* between the two ribbon elements making up the composite ribbon element 129*a* and 129*b*. This method affords considerable control over the adhesives effect on the ribbon element's mechanical properties and has proven by test to be effective in controlling resonances, improving motional control, and lowering the distortions typically found in the smaller ribbon transducers.

It is to be understood that in the above mentioned "composite" configuration of two ribbon elements formed with different corrugation angles and bonded together, such that the corrugation angles chosen are not limited to the optimum window of corrugation angles)(64°±10° chosen in the first embodiment described above.

Testing of the composite configuration has shown that any corrugation angle is effective, so long as the construction results in each corrugation peak of one ribbon element crossing two or more corrugation peaks of the ribbon element it is bonded to. This construction results in a composite free swinging ribbon element that achieves desirable improvements in performance with an easily tunable mechanical property achieved by virtue of adjusting the number of adhesive contact points between each ribbon element of the composite by choice of corrugation angles.

Testing has shown that composite ribbons such as 129*b* with corrugation angles $\theta_1$ and $\theta_2$ closer to the X-axis, thus having fewer adhesive contact points 120*b* and less stiffness in the longitudinal dimension Y, work well at controlling resonances in the critical midrange frequencies from approximately 300 Hz to 3000 Hz with the best results obtained with corrugation angles between approximately 25° and 45° with respect to the X-axis. Composite ribbons such as 129*a* with larger corrugation angles θ and thus more adhesive contact points 120*a* and increased stiffness in the longitudinal dimension Y worked best at controlling resonances below approximately 300 Hz.

Methods of Forming the "Composite Ribbon" Embodiment

It is understood that the "corrugation peaks" are the areas of each ribbon element in closest proximity to the ribbon element it is being bonded to forming a "composite" ribbon element made up of two ribbon elements or one long or element folded back over itself.

Figure 13:
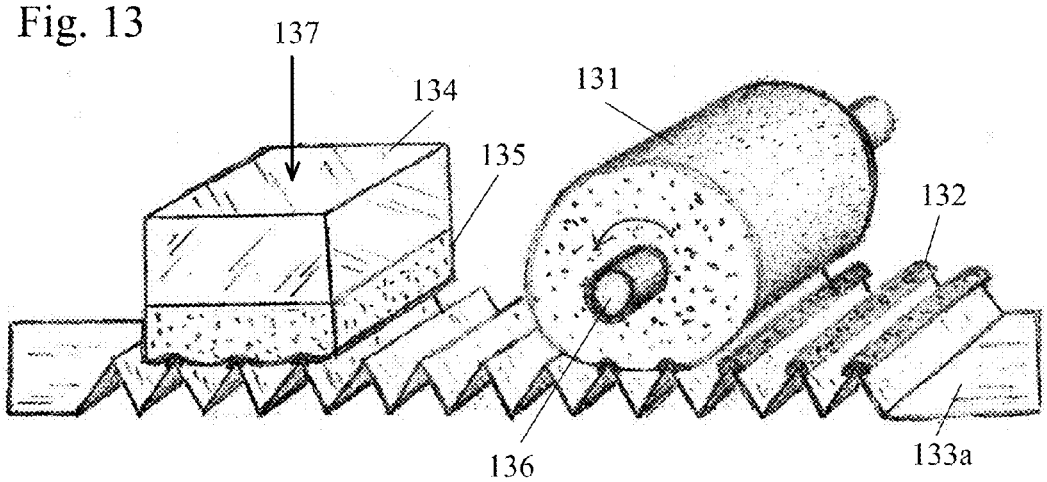
FIG. 13 shows an apparatus for applying adhesive to corrugation peaks for the composite embodiment of FIG. 15.
Figure 14:
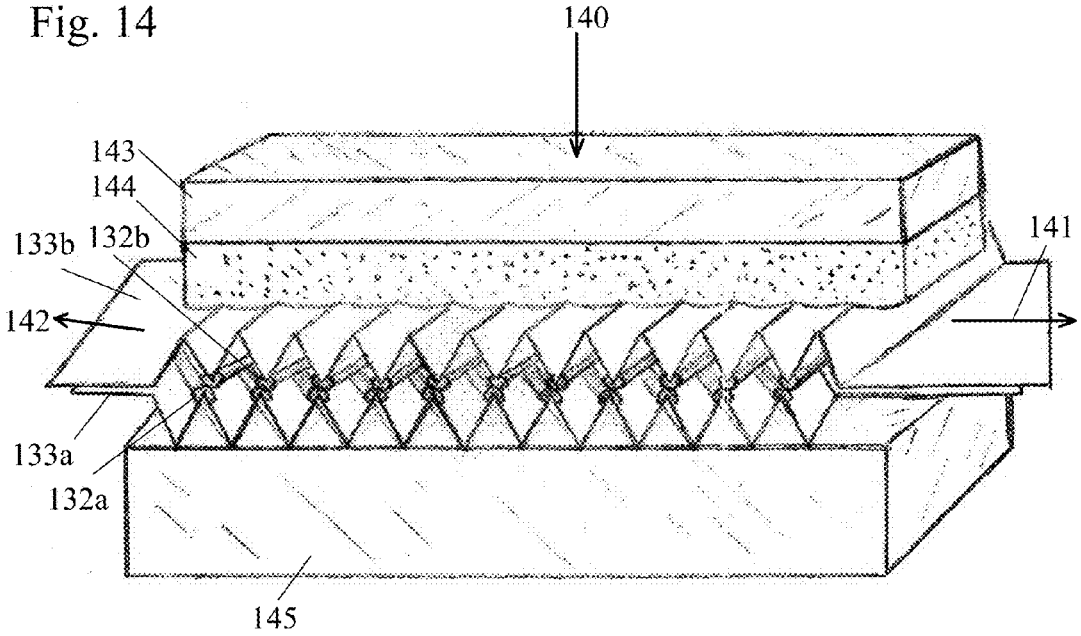
FIG. 14 shows a method of bonding the two ribbon elements together to form a "composite" ribbon element of the embodiment of FIG. 15.

FIGS. 13 and 14 show a method of making the composite ribbon embodiment of the invention.

First, the two ribbon elements 133*a* and 133*b* are formed. This can be done by the methods described above, which are not separately discussed here.

Then, as shown in FIG. 13, an adhesive, preferably of a soft visco-elastic nature, is applied to the corrugation peaks 132 of each of the ribbons—in this figure, only ribbon 133*a* is shown, but it will be understood that the same technique is preferably applied to both ribbons 133*a* and 133*b*. In some applications, a thicker layer of adhesive might be applied to only one ribbon, as long as the ribbons are put together before the adhesive sets.

FIG. 13 shows two different methods of applying the adhesive. A first method uses a soft foam pad coated with adhesive 135, which can be mounted on a block 134 as shown. Pressure 137 is applied to the block 134 to apply the adhesive to the corrugation peaks 132. Alternatively, a second method uses a soft foam roller 131 rotating on an axle 136. The roller 131 can be continuously supplied with adhesive, and the adhesive is then applied to the corrugation peaks 132 as the roller 131 revolves on axle 136, moving along the ribbon 133*a*.

For mid-range transducers, adhesive is preferably a visco-elastic material so that when the ribbons are bonded together, there is still some movement possible between the ribbons. This provides a damping effect which is useful at those frequencies. Appropriate adhesives for this application include rubber-based adhesives such as rubber cement, contact adhesive or urethane materials.

In the very low bass frequencies this damping is not needed and in some applications you do not want the damping effect, as it is a "lossy" effect that can lower efficiency. Testing has shown that use of hard setting adhesives such as epoxy in the composite ribbon show increased efficiency below 150 Hz over those constructed with visco-elastic adhesives. This would prove beneficial in some designs, particularly in "dipole" loudspeakers where there is no baffle (cabinet) and the desire is to have a rising response as you approach the fundamental resonance to counter the falling response due to leakage around the baffle's edge.

FIG. 14 shows the method of bonding the two ribbon elements 133*a* and 133*b* together. Ribbon elements 133*a* and 133*b* are positioned over a rigid platform 145. Light tension is applied at the ends 141 and 142 of each ribbon element 133*a* and 133*b* to straighten the elements slightly as they are laid atop each other. A rigid beam 143 with a light foam 144 attached to its lower surface is used to apply a light force 140 sufficient to make the necessary contact between each ribbon element without crushing the corrugations 132*a* 132*b* while the adhesive is cured.

With this design it is advisable to allow the composite ribbon element to run at low power (approximately ½ to 1 watt) for approximately 1 hour before applying elevated power to the unit. This "burn in" period exercises the structure uniformly distributing localized stresses that result from manufacture of the element.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A ribbon transducer comprising:

a) a first termination;

b) a second termination, mounted parallel to the first termination and separated from the first termination by a distance;

c) a ribbon element having a first end electrically and mechanically coupled to the first termination, a second end electrically and mechanically coupled to the second termination, a first side and a second side, a width having a transverse axis between the first side and the second side, and a length having a longitudinal axis running between the first end and the second end;

d) a plurality of corrugations formed on the ribbon element at an angle of 45° to 75° to the transverse axis of the ribbon element, the corrugations being evenly spaced along the length of the ribbon element;

e) a first permanent magnet mounted adjacent to the first side of the ribbon element, parallel to the longitudinal axis of the ribbon element, and separated from the first side of the ribbon element by a gap; and f) a second permanent magnet mounted adjacent to the second side of the ribbon element, parallel to the longitudinal axis of the ribbon element, and separated from the second side of the ribbon element by a gap.

2. The ribbon transducer of claim 1, in which the corrugations are formed on the ribbon element at an angle of 54° to 74° to the transverse axis of the ribbon element.

3. The ribbon transducer of claim 1, in which the first termination and the second termination are clamps which are tightened on the ribbon element to adjust a tension of the ribbon element.

4. The ribbon transducer of claim 1, further comprising a base plate on which the first termination, the second termination, the first permanent magnet and the second permanent magnet are mounted.

5. A ribbon element for a ribbon transducer comprising a body having a first end, a second end, a first side and a second side, a width having a transverse axis between the first side and the second side, and a length having a longitudinal axis running between the first end and the second end, and a plurality of corrugations formed on the body of the ribbon element at an angle of 45° to 75° to the transverse axis of the ribbon element, the corrugations being evenly spaced along the length of the ribbon element.

6. The ribbon element for a ribbon transducer of claim 5, in which the corrugations are formed on the ribbon element at an angle of 54° to 74° to the transverse axis of the ribbon element.

7. A composite ribbon element for a ribbon transducer, comprising:

a) a first ribbon element comprising a body having a first end, a second end, a first side and a second side, a width having a transverse axis between the first side and the second side, and a length having a longitudinal axis running between the first end and the second end, and a plurality of corrugations formed on the body of the first ribbon element at a first angle relative to the transverse axis of the first ribbon element, the corrugations being evenly spaced along the length of the first ribbon element;

b) a second ribbon element adjacent and parallel to the first ribbon element, comprising a body having a first end, a second end, a first side and a second side, a width having a transverse axis between the first side and the second side, and a length having a longitudinal axis running between the first end and the second end, and a plurality of corrugations formed on the body of the second ribbon element at a second angle relative to the transverse axis of the second ribbon element, the corrugations being evenly spaced along the length of the second ribbon element; the second angle being different from the first angle, such that the corrugations of the first ribbon element contact facing corrugations of the second ribbon element at at least two points of contact on each corrugation; and c) an adhesive adhering the corrugations of the first ribbon element to the facing corrugations of the second ribbon element at the points of contact.

8. The composite ribbon element of claim 7, in which the first angle is in a range of 25° to 45°.

9. The composite ribbon element of claim 7, in which the second angle is in a range of 25° to 45°.

10. The composite ribbon element of claim 7 in which the adhesive is a visco-elastic adhesive selected from a group consisting of rubber cement, contact cement and urethane.

* * * * *